US009707672B2

(12) United States Patent
Belding

(10) Patent No.: US 9,707,672 B2
(45) Date of Patent: Jul. 18, 2017

(54) SNAP-TIE TOOL

(76) Inventor: William Belding, Grass Valley, CA (US)

( * ) Notice: Subject to any disclaimer, the term of this patent is extended or adjusted under 35 U.S.C. 154(b) by 1335 days.

(21) Appl. No.: 13/453,172

(22) Filed: Apr. 23, 2012

(65) Prior Publication Data

US 2012/0272492 A1 Nov. 1, 2012

Related U.S. Application Data

(60) Provisional application No. 61/479,126, filed on Apr. 26, 2011.

(51) Int. Cl.
*B25B 27/14* (2006.01)
*B25B 27/00* (2006.01)
*E04G 17/06* (2006.01)

(52) U.S. Cl.
CPC ..... *B25B 27/00* (2013.01); *E04G 17/06* (2013.01); *Y10T 29/53943* (2015.01)

(58) Field of Classification Search
USPC ..... 23/278
See application file for complete search history.

(56) References Cited

U.S. PATENT DOCUMENTS 307,544 A * 11/1884 Hardwick ..... B25C 11/00 254/25
901,210 A * 10/1908 Tarrant ..... A01K 15/003 119/717
1,328,964 A * 1/1920 Penn ..... A24F 47/00 294/26
1,344,619 A * 6/1920 Colvin ..... B25B 31/005 269/47
2,525,950 A * 10/1950 Saffioti ..... E04G 17/0642 254/29 A
2,610,884 A * 9/1952 Enderle ..... A47G 21/00 294/15
2,646,703 A * 7/1953 Erbe ..... E04G 17/0642 249/213
2,861,143 A * 11/1958 Grover ..... H01H 5/18 200/407
3,411,742 A * 11/1968 McArdle ..... E04G 17/0721 249/205
3,438,290 A * 4/1969 Konopacki ..... E05B 19/20 70/465
3,470,600 A * 10/1969 Hosbach ..... B25B 27/20 29/229
3,473,578 A * 10/1969 McArdle ..... E04G 17/0642 140/149
3,680,834 A * 8/1972 Holloway ..... B25F 1/00 254/25
3,680,835 A 8/1972 Rose
(Continued)

*Primary Examiner* — Alvin Grant
(74) *Attorney, Agent, or Firm* — Buckingham, Doolittle & Burroughs, LLC

(57) ABSTRACT

A tool designed for aligning and positioning snap-ties used in assembling the structural concrete shaping forms. The tool comprises a shaft member fixedly attached to a slotted engaging member for engaging the snap-ties. The slotted engaging member typically has a tapered slot so that the user may easily encompass the snap-tie and position it in a single step without the need to temporarily lock the snap-tie to the tool during positioning. The tool also allows the user to position snap-ties remotely without the need for the user's body to enter a concrete form apparatus, thereby decreasing the chance of injury.

6 Claims, 3 Drawing Sheets

(56) References Cited

U.S. PATENT DOCUMENTS 3,744,758 A * 7/1973 Nakasone ..... B65G 7/12 254/129
3,756,562 A 9/1973 Ward
3,835,489 A * 9/1974 Lagace ..... B25F 1/00 140/149
4,096,618 A * 6/1978 Perline ..... B25B 31/00 29/278
D256,442 S * 8/1980 Martin ..... 254/25
4,469,042 A * 9/1984 Ogg ..... B63B 21/44 114/304
4,573,857 A * 3/1986 Porter, Sr. ..... B60P 3/125 280/402
D300,713 S * 4/1989 Trapasso ..... D8/1
5,212,860 A * 5/1993 Lakey ..... B25B 9/00 29/270
5,322,264 A * 6/1994 Giambro ..... B25C 11/00 254/25
5,407,194 A * 4/1995 Snow ..... A63B 47/02 294/19.2
5,535,982 A 7/1996 Zayic
5,695,172 A * 12/1997 Hreha ..... B66F 15/00 254/18
5,741,395 A * 4/1998 Mozelack ..... B01D 29/111 156/304.2
5,749,113 A * 5/1998 Witter ..... B25C 11/00 254/131
5,930,884 A * 8/1999 Kammeraad ..... B25B 27/00 29/267
5,957,429 A * 9/1999 Khachatoorian ..... B25C 11/00 254/21
6,125,517 A * 10/2000 Yu ..... B25B 27/20 29/229
6,159,215 A * 12/2000 Urbahns ..... A61B 17/025 606/86 R
6,308,934 B1 * 10/2001 Gallo ..... B25C 11/00 254/21
6,360,637 B1 * 3/2002 Weinraub ..... E05B 19/20 81/15.9
6,415,468 B1 7/2002 Spaur
6,505,817 B1 * 1/2003 Witter ..... E04H 17/265 254/132
6,644,627 B1 * 11/2003 Forrester ..... B66F 15/00 254/131
6,886,229 B1 * 5/2005 Wilson ..... B25B 27/04 29/267
6,948,700 B2 * 9/2005 Wood ..... B66F 15/00 254/18
7,048,255 B2 * 5/2006 Buch ..... B25C 11/00 254/25
7,389,965 B2 * 6/2008 Oddsen, Jr. ..... F16M 11/04 248/274.1
7,540,457 B2 * 6/2009 Oddsen, Jr. ..... F16M 11/04 248/278.1
7,618,020 B2 * 11/2009 Del Favero ..... B66F 15/00 254/131
7,618,031 B2 * 11/2009 Weaver ..... B66F 15/00 269/131
7,634,845 B1 * 12/2009 Sim ..... B25B 27/0035 254/25
7,676,896 B1 * 3/2010 Carscadden ..... B25B 23/18 254/25
7,707,700 B1 * 5/2010 Lapetina ..... A62B 3/00 29/25
7,726,713 B2 * 6/2010 Oleksia ..... A62B 3/005 254/131
7,946,010 B1 * 5/2011 Myers ..... B26F 1/0015 29/213.1
8,061,688 B2 * 11/2011 Darbinyan ..... B66F 15/00 254/129
8,220,851 B1 * 7/2012 Dawes ..... B60C 25/04 157/1.3
8,286,535 B1 * 10/2012 McCartney ..... B25B 13/00 254/21
8,365,332 B2 * 2/2013 Allen ..... B66F 15/00 254/18
8,365,378 B1 * 2/2013 Lenart ..... B25B 33/00 15/236.01
8,375,545 B2 * 2/2013 Sim ..... B25B 27/0035 254/25
8,535,323 B2 * 9/2013 Keefer ..... A61F 2/4637 254/10.5
2002/0174908 A1 * 11/2002 Prunty ..... E04G 17/0642 140/123
2004/0227131 A1 * 11/2004 Wood ..... B66F 15/00 254/25
2005/0241250 A1 * 11/2005 Tarr ..... E02D 31/02 52/266
2010/0127226 A1 * 5/2010 Smith ..... E04G 23/08 254/27
2011/0030182 A1 * 2/2011 Jung ..... A63B 57/0037 29/278

* cited by examiner

FIG. 1
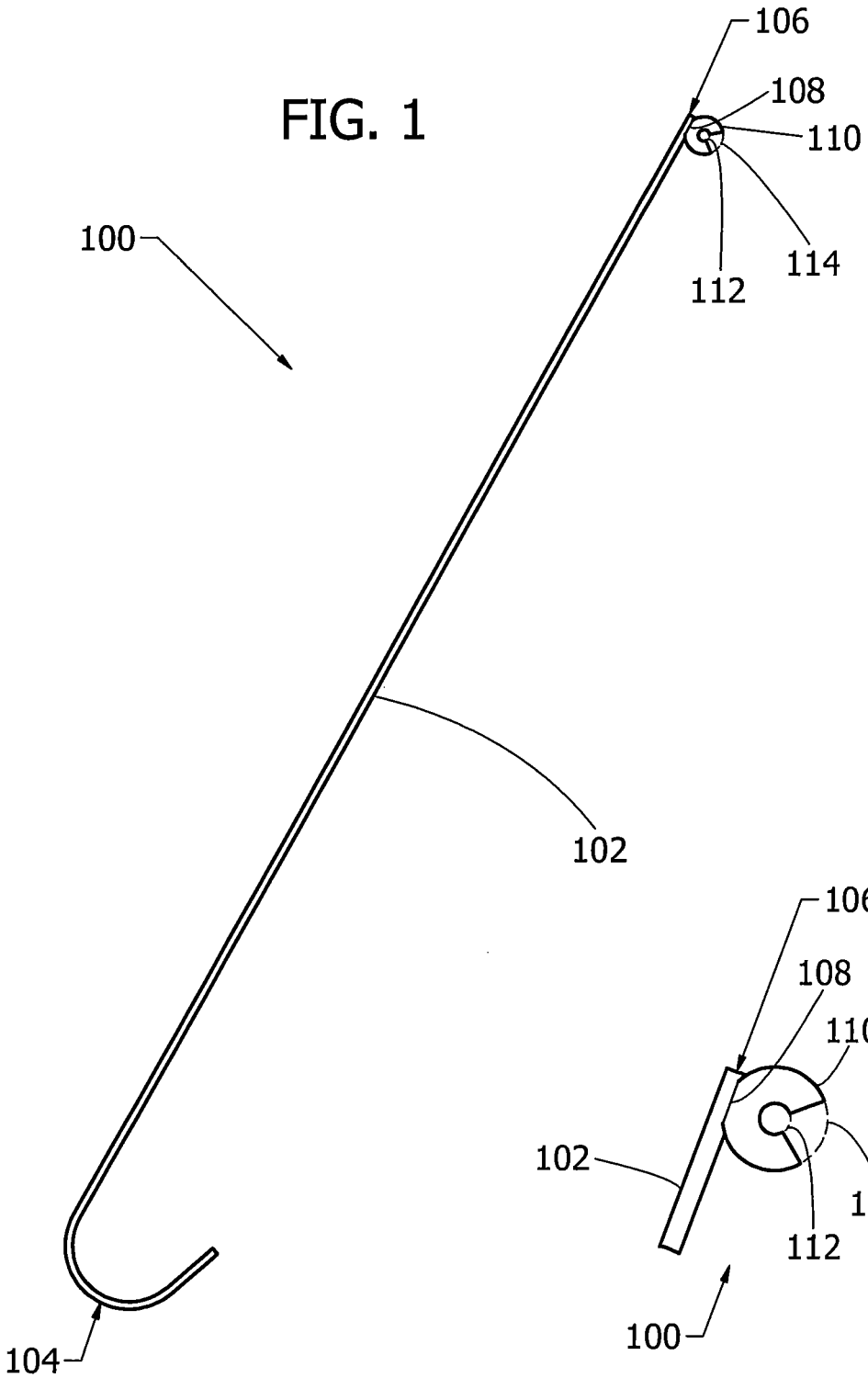
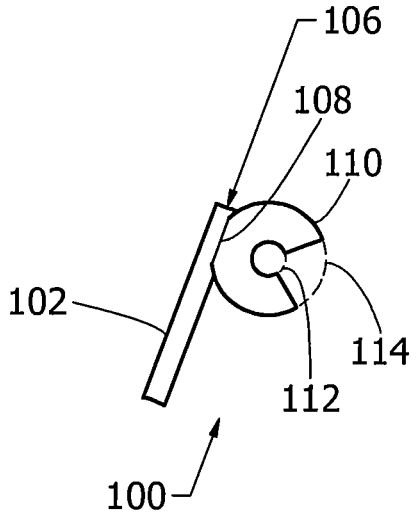
FIG. 1A

SNAP-TIE TOOL

CROSS-REFERENCE

This application claims priority from Provisional Patent Application Ser. No. 61/479,126 filed Apr. 26, 2011.

FIELD OF THE INVENTION

This invention pertains generally to a construction tool and more particularly to a tool for aligning and positioning snap-ties for use in assembling the forms used for shaping structural concrete.

BACKGROUND

Concrete structures commonly require a supporting form typically constructed of plywood panels to keep the concrete in a desired shape until sufficiently cured. The plywood panels are usually held together with a tie rod system such snap-ties. The snap-ties help keep the plywood panels in alignment and maintain the proper spacing for the concrete. Once the plywood panels are in place along with other structural components such as a rebar framework, a user positions the snap-ties and secures them to the plywood. Assembly can be both labor-intensive and dangerous. Manipulating and securing a snap-tie into position requires significant effort and often puts the individual in danger as the individual must reach into the framework to secure the snap-tie. As the framework comprises metal bars and plywood panels, the user's body is at risk to be cut, smashed, punctured, or otherwise injured. Additionally, as the process is time consuming, productivity is diminished.

Consequently, there exists a need for a more efficient and safer tool designed to guide a snap-tie into position in a concrete form without the need for an individual to physically enter the form. The present invention discloses a tool for positioning and manipulating snap-ties within a concrete form for use by carpenters, bridge builders, and the like, or by anyone working with structural concrete. The tool allows workers to save time and energy while safely reaching a form panel connection. The tool is able to position, manipulate, and secure snap-ties within a concrete form remotely without the need for an individual to reach into the form.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a positioning tool for use in positioning, manipulating, and securing a snap-tie within a concrete form without the need to reach into the form. The positioning tool comprises a shaft member with a first end and a second end. The first end is typically curved for use as a hand hold and for hanging the tool when not in use. A slotted engaging member is secured to the second end for use in manipulating the snap-tie.

Furthermore, in the preferred embodiment of the invention, the slotted engaging member is a washer with a tapered slot cut out that is welded or otherwise permanently affixed to the second end of the positioning tool. The tapered slot is dimensioned so that the washer may fit around and engage the snap-tie for positioning. The shaft member is typically long enough so that a user does not need to place any part of his body into a concrete form apparatus. Once the snap-tie is placed and secured, the positioning tool may be hung by the first end when no longer needed.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

FIG. 1 illustrates a perspective view of a snap-tie positioning tool in accordance with the disclosed architecture.

FIG. 1A illustrates a close-up cut away perspective view of a second end of the snap-tie positioning tool in accordance with the disclosed architecture.

DETAILED DESCRIPTION

Figure 2:
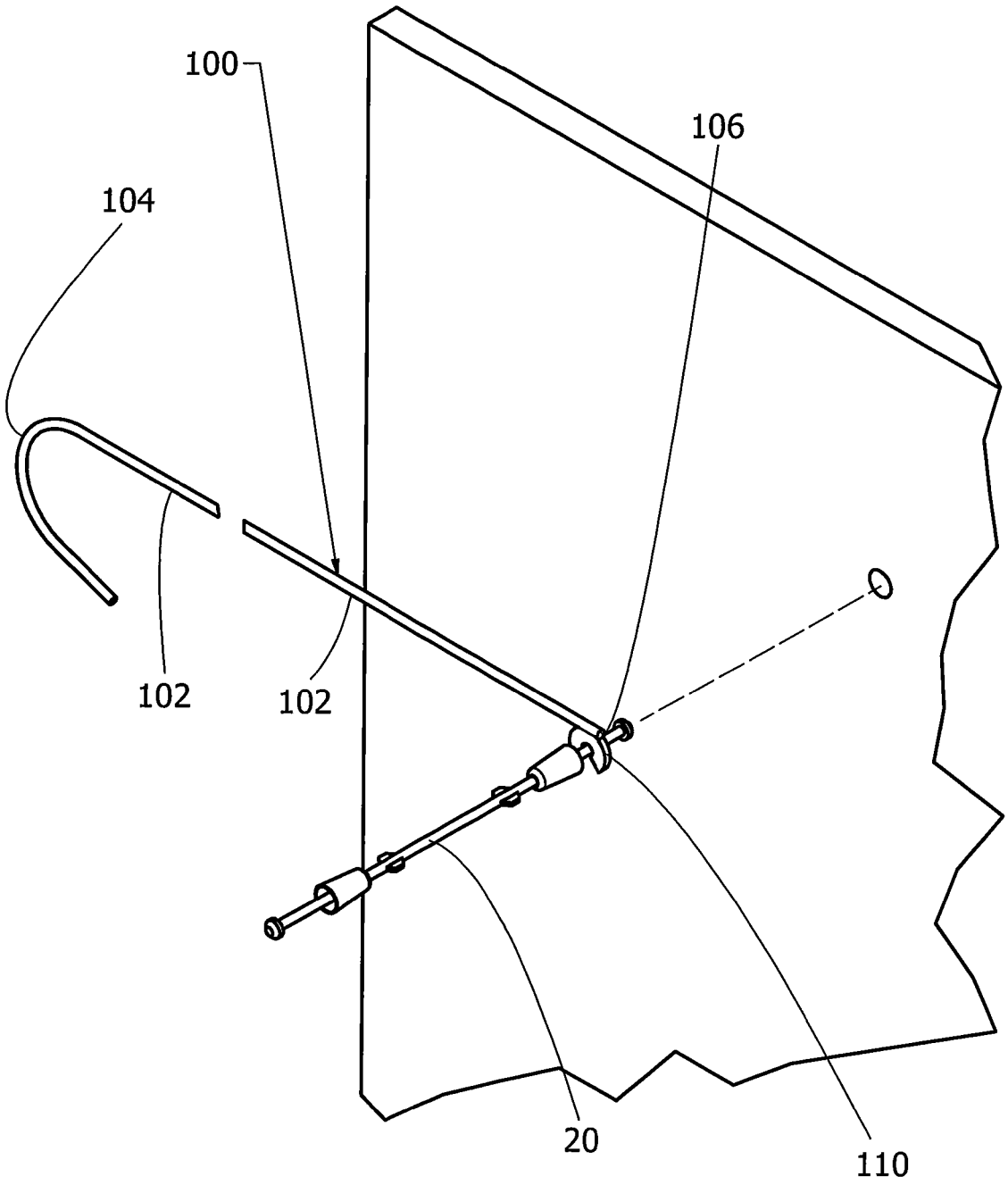
FIG. 2 illustrates a perspective view of the snap-tie positioning tool engaging and positioning a snap-tie in a concrete form apparatus in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

The present invention discloses a tool for use in easily and safely positioning a snap-tie in a concrete form apparatus. The tool comprises a shaft member with a slotted engaging member. The tool allows a user to push and/or pull the snap-tie into position without the need for any part of the user's body to enter the concrete form apparatus, thereby significantly increasing the safety of the operation. The tool is designed for use by carpenters, construction workers, and the like, where uncured concrete requires a form to maintain its shape during pouring and prior to curing.

Figure 3:
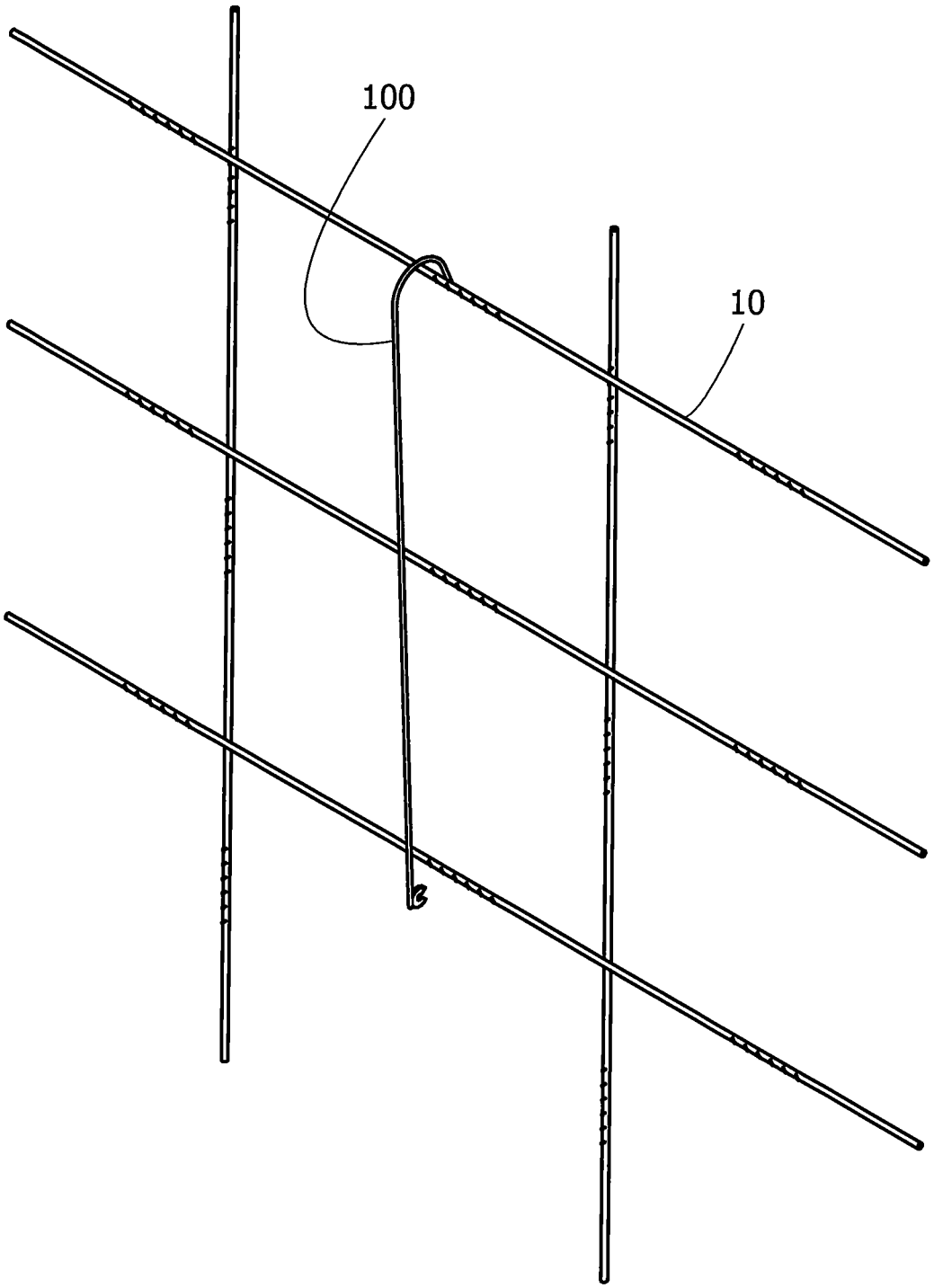
FIG. 3 illustrates a perspective view of a snap-tie positioning tool in a non-use position in accordance with the disclosed architecture.

Referring initially to the drawings, FIGS. 1-3 illustrate a tool 100 designed for efficiently and safely positioning a snap-tie 20 used in maintaining the shape of a concrete form apparatus 10 during the pouring and curing of structural concrete without the need for a user to enter the concrete form apparatus 10. The tool 100 comprises a shaft member 102 having a first end 104 and a second end 106. The shaft member 102 is generally constructed of a high tensile steel of approximately grade 60 (yield strength of approximately 60,000 pounds per square inch), however any other suitable highly durable material such as high tensile steel with a grade of approximately between 40 to 80, cold rolled steel, stainless steel, galvanized steel, high strength composite materials, and the like, as is known in the art may be used without affecting the overall concept of the invention. The high tensile steel is preferable as it has yield strength that prevents the tool 100 from significantly bending or deforming during use. For example, a minimum yield strength of approximately 60 kips per square inch, or the equivalent, will typically be adequate to resist any deformation forces associated with positioning the snap-tie 20 within the concrete form apparatus 10.

The shaft member 102 is generally a pencil rod type shape of rounded steel metal approximately between 3/16 to 7/16 inches in diameter, and approximately between 36 and 64 inches long. While the shaft member 102 is typically cylindrical in shape, this is not meant as a limitation as any suitable shape or size as is known in the art may be used without affecting the overall concept of the invention.

The first end 104 is designed to be grasped by the user to push and/or pull the snap-tie 20 into position. Preferably, the first end 104 is curved into a hook shape having a radius of approximately two inches. As seen in FIG. 3, as the tool 100 is portable, the hook shape is convenient for hanging or storing the tool 100 when not in use on a rebar framework in the concrete form apparatus 10 commonly found in concrete construction. The hook shape is also easy to grasp by the user when employing the tool 100. While the radius of the hook shape is preferably approximately two inches, this is not meant as a limitation as any suitable shape and/or radius as is known in the art may be used without affecting the overall scope of the invention. For example, the first end 104 could be rectangular in shape with an ergonomic hand grip (not shown) of a suitable material to increase the comfort of the user. Additionally, the first end 104 and/or the second end 106 may be colored or painted, for example yellow, so as to improve visibility when the tool 100 is in use.

As illustrated in FIGS. 1 and 1A, the second end 106 of the shaft member 102 comprises an attachment point 108 located at a distal position on the second end 106. The tool 100 further comprises a slotted engaging member 110. The slotted engaging member 110 is fixedly attached or otherwise secured along the distal position of the second end 106 at the attachment point 108. While a weld is preferred to fixedly attach the slotted engaging member 110, any method of permanently securing and holding the slotted engaging member 110 in place at the attachment point 108 as is known in the art may be used without affecting the overall scope of the invention.

The slotted engaging member 110 is typically a 3/8$^{th}$ inch galvanized washer as it is economical and easy to secure, however, the size of the washer may range approximately between 1/4$^{th}$ and 1 inch and still be within the scope of the invention. Typically, the slotted engaging member 110 is welded to the attachment point 108 on the second end 106 so that the slotted engaging member 110 is aligned with the shaft member 102 in a substantially parallel orientation. In other words, the washer is welded along a circumference of the washer so that the washer protrudes off of the shaft member 102 at approximately 90 degrees substantially in line with the shaft member 102.

The slotted engaging member 110 preferably comprises a tapered slot. The tapered slot is typically orientated to face substantially opposite of the attachment point 108. In other words, the tapered slot faces away from the shaft element 102. The tapered slot preferably comprises a section cut out from the slotted engaging member 110 with an inner arc 112 of approximately 5/16$^{th}$ of an inch in length and an outer arc 114 of approximately 3/8$^{th}$ of an inch in length. However, this is not meant as a limitation as the tapered slot may be configured in shapes comprising a wedge, a triangle, an angled slot, a curved taper, and the like, and of any dimension that permits the slotted engaging member 110 to engage the snap-tie 20. For example, in an embodiment with a square shaped washer as the slotted engaging member 110, the tapered slot could be cut with approximately parallel cuts so that the inner arc 112 and the outer arc 114 are approximately the same length if desired.

The function of the slotted engaging member 110 is to receive the snap-tie 20 through the tapered slot so that the tool 100 may be used to position the snap-tie 20 within the concrete form apparatus 10. As seen in FIG. 2, once the snap-tie 20 is engaged, the user simply pulls the snap-tie 20 toward the user into a hole or other securing position in a plywood form member. Alternatively, the user may push the snap-tie 20 away from the user toward the hole or other securing position in the concrete form apparatus 10. Typically, once guided into place, the snap-tie 20 extends through the hole and is externally secured to the plywood form member, thereby holding the concrete form apparatus 10 in place while concrete is poured and cured. The tool 100 surrounds the snap-tie 20 without the need to temporarily lock the snap-tie 20 in place saving installation time. The tool 100 utilizes a single working end to accomplish the entire positioning of the snap-tie 20 remotely so that no part of the users body need enter the concrete form apparatus 10 risking injury.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tool for use in positioning a snap-tie, the tool comprising:

a shaft member comprised of a high tensile steel with a yield strength of between 40,000 and 80,000 pounds per square inch between 36 and 64 inches in length and between 3/16 and 7/16 inches in diameter comprising a first end comprising a radius of approximately two inches and a second end, wherein the first end is curved; and a slotted engaging member comprising a flat round metal disk comprising:

an outer circumference;

an inner circumference; and a tapered slot cut into the flat round metal disk decreasing in dimension from the outer circumference to the inner circumference; and wherein the outer circumference of the flat round metal disk is welded to the second end of the shaft member so that the tapered slot extends substantially perpendicularly away from and in-line with the shaft member.

2. The tool of claim 1, wherein the tapered slot is configured in at least one of the following shapes: a wedge, a triangle, an angled slot, or a curved taper.

3. The tool of claim 2, wherein the tapered slot comprises an inner arc approximately 5/16 inches in length and an outer arc approximately 3/8 inches in length.

4. The tool of claim 3, wherein the inner circumference of the slotted engaging member is capable of receiving the snap-tie.

5. The tool of claim 4, wherein the first end is hook shaped.

6. The tool of claim 5, wherein the shaft member further comprises a round high tensile steel shaft.

* * * * *